US006045005A

United States Patent [19]

Stratton

[11] Patent Number: 6,045,005

[45] Date of Patent: Apr. 4, 2000

[54] CAULKING GUN WITH INTEGRAL CAULKING TUBE SNOUT CUTTER

[75] Inventor: Leonard Stratton, North Royalton, Ohio

[73] Assignee: Viking Caulking Gun Company, Cleveland, Ohio

[21] Appl. No.: 09/065,698

[22] Filed: Apr. 24, 1998

[51] Int. Cl.[7] ..... B67D 5/00

[52] U.S. Cl. ..... 222/83.5; 222/81; 222/82; 222/83; 222/391

[58] Field of Search ..... 222/81, 82, 83, 222/83.5, 391, 325, 326, 327; 83/580; 30/226, 233, 261

[56] References Cited

U.S. PATENT DOCUMENTS

| | | |
|---|---|---|
| 4,081,112 | 3/1978 | Chang . |
| 4,135,644 | 1/1979 | Pacetti . |
| 4,390,115 | 6/1983 | Bigham . |
| 4,493,437 | 1/1985 | Breeden . |
| 4,802,607 | 2/1989 | Johnson . |

*Primary Examiner*—Kevin Shaver
*Assistant Examiner*—David Deal
*Attorney, Agent, or Firm*—Renner, Otto, Boisselle & Sklar, P.L.L.

[57] ABSTRACT

A caulking gun includes a receptacle for holding a tube of caulk and a handle which has a trigger. A plunger in the receptacle is incrementally advanced by a plunger drive in the handle to push caulking material out a hollow conical snout at a far end of the tube. The trigger has outwardly flared sections or flanges and one of the flanges has a sharpened edge forming a blade. The flanges contact the interior of the handle. To open the snout to dispense caulking material, the snout of the caulking tube is inserted through an opening in a side wall of the handle to the desired depth and angle, the trigger is squeezed, and the blade moves across the opening to sever a tip of the snout and thus create an opening for dispensing the caulking material. The opposing flanges and the elasticity of the handle ensure that the blade maintains contact with the handle around the opening. Thus a clean and consistent cut may be made in the snout of a caulking tube, and the caulking gun is able to provide a consistently clean and uniform bead of caulk.

22 Claims, 4 Drawing Sheets

CAULKING GUN WITH INTEGRAL CAULKING TUBE SNOUT CUTTER

FIELD OF THE INVENTION

The invention described below relates to hand tools and, more particularly, to manually actuated caulking guns.

BACKGROUND OF THE INVENTION

A caulking gun dispenses a bead of caulking material or caulking compound to seal and/or to fill cracks, joints, and openings. A disposable tube, cartridge or other container of caulking material generally is cylindrical with a disk shaped base at one end and a substantially cone-shaped snout at an opposite end for dispensing caulking compound. Caulking guns generally include a receptacle or cage for holding the container of caulking compound, a plunger, and a handle. The plunger engages the base of the caulking tube. A trigger in the handle is used to actuate a plunger drive which advances the plunger and the disk shaped base into the caulking tube to dispense caulking compound from a tip of the snout.

The snout on a caulking tube is generally formed of a plastic type material and is sealed at the tip to extend the shelf-life of the caulking material. The tip of the snout is cut to open the snout and to provide a desirably sized and angled opening for dispensing the caulking compound from the tube. The tip of the snout can and often is cut with a knife or other handheld blade.

Several problems exist with this practice, however. First, a knife or other blade and/or a suitable cutting surface may not be readily available. Furthermore, most knives cannot provide a satisfactorily clean and accurate cut, leading to an undesirably jagged or irregular edge around an improperly sized opening. A jagged or irregular edge around the opening in the snout leads to an undesirably irregular bead of caulking material. As a result, the quality of the caulking job is inadequate and inefficient.

One attempt to provide a snout cutter uses a small blade welded to the trigger adjacent an opening in the handle. The snout is inserted through the opening and is cut by squeezing the trigger which moves the blade through the snout. Unfortunately, however, the distance between the portion of the handle having the opening and the blade on the handle cannot be consistently determined and a significant gap often forms between the handle and the blade. This gap may lead to vibration from the cutting motion and may prevent an efficient shearing action between the handle and the blade, thereby preventing a consistently clean and accurate cut to open the snout. In fact, the blade may move hesitantly or with a jerky motion to create an irregular and rough cut across the snout.

In addition, welding a blade to the trigger requires an extra step in the manufacturing process. The blade is extra material which must be attached to the trigger, and in so doing, compensation must be made for the effects of the heat of the weld and the addition of welding material. If the blade is placed in the wrong position on the trigger or if the trigger no longer fits within the handle, either because there is not enough space between the blade and the handle or because there is too much space between the blade and the handle, it is very difficult to remedy this problem during production. Fixing such problems requires even more steps.

SUMMARY OF THE INVENTION

The present invention relates to a caulking gun and method for an integral caulking tube snout cutter which provide a consistently clean cut. More specifically, the present invention relates to a caulking gun with an integral caulking tube snout cutter formed as an integral part of a trigger in a handle of the caulking gun.

In an embodiment of the present invention a caulking gun includes a receptacle for holding a tube of caulk and a handle which has a trigger. A plunger in the receptacle may be incrementally advanced by a plunger drive in the handle to push caulking material out a hollow conical snout at a far end of the tube. The trigger has outwardly flared sections or flanges and one of the flanges has a sharpened edge forming a blade. The flanges contact the interior of the handle. To open the snout to dispense caulking material, the snout of the caulking tube is inserted through an opening in a side wall of the handle to the desired depth and angle, the trigger is squeezed, and the blade moves across the opening to sever a tip of the snout to create an opening for dispensing the caulking material. The opposing flanges and the elasticity or resilience of the handle ensure that the blade maintains contact with the handle around the opening. Thus a clean and consistent cut may be made in the snout of a caulking tube, and the caulking gun is readily able to urge caulk from the caulking tube to provide a consistently clean and uniform bead of caulk.

In an embodiment, the caulking gun of the present invention includes a holder to hold a container of caulking material and a handle connected to the holder. The handle has at least one opening in a side wall. The caulking gun further includes a trigger connected to the handle and the trigger has at least one flange which contacts the side wall of the handle having the opening. Furthermore, the trigger is connected to the handle so that when the trigger is squeezed against the handle, the flange moves across the opening.

In an embodiment, the trigger of a caulking gun has a pair of flanges which contact opposing side walls of the handle. The elasticity of the handle material maintains the contact between the flanges and the side walls of the handle. The flange which is movable across the opening preferably has a sharpened edge. In addition, the holder includes a plunger and movement of the trigger actuates a plunger drive in the handle to advance the plunger.

In an embodiment, the trigger of a caulking gun has a hollow U-shape cross-section that is open on the side facing the handle. The trigger is telescopically connected to the handle and is spring biased to a position away from the handle. The handle has a hollow U-shape cross-section that is open on a side facing the trigger. The trigger has a width which is less than a width of the handle such that the trigger can telescope into the handle.

Furthermore, in accordance with an embodiment of the present invention, a method of using a caulking gun to dispense a caulking material from a caulking container having a substantially hollow snout at one end includes the following steps. The method includes the steps of inserting the snout through an opening in a handle of the caulking gun, and squeezing a trigger which is connected to the handle toward the handle. In the squeezing step, a pair of flanges, which are part of the trigger, engage opposing side walls of the handle and at least one flange has a sharpened edge which moves across the opening to sever a tip of the snout.

According to an embodiment, the method may further include the steps of placing the caulking container into a holder of the caulking gun having a plunger; and squeezing the trigger toward the handle to incrementally advance the plunger to dispense the caulking material from the snout. The squeezing step also may include telescoping the trigger into the handle. In the squeezing step, the action of squeezing the trigger toward the handle is opposed by a spring which biases the trigger to an extended position away from the handle. The method may further include the step of supporting the caulking tube with the plunger and a front end cap having a slot to receive the snout.

The present invention also contemplates a method of making a caulking gun which includes the steps of forming a handle having a hollow U-shape cross section with at least one opening in at least one side wall; forming a trigger having a hollow U-shape cross section; stamping a pair of flanges in opposing side walls of the trigger; grinding or otherwise forming at least one flange to form a sharpened edge; connecting the trigger to the handle so that the flanges engage opposing sides of the handle and so that squeezing the trigger toward the handle causes the sharpened edge to move across the opening; and connecting the handle to a caulking tube holder.

According to another embodiment, the step of forming the handle may include forming the handle with a handle width and the step of forming the trigger may include forming the trigger with a trigger width that is less than the handle width; the step of connecting may include pivotally connecting the trigger to the handle so that pivoting the trigger causes the trigger to telescope into the handle; the stamping step may include hitting at least one flange to form a thin distal edge and the grinding step may include grinding the thin distal edge to form a sharpened edge.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION

Figure 1:
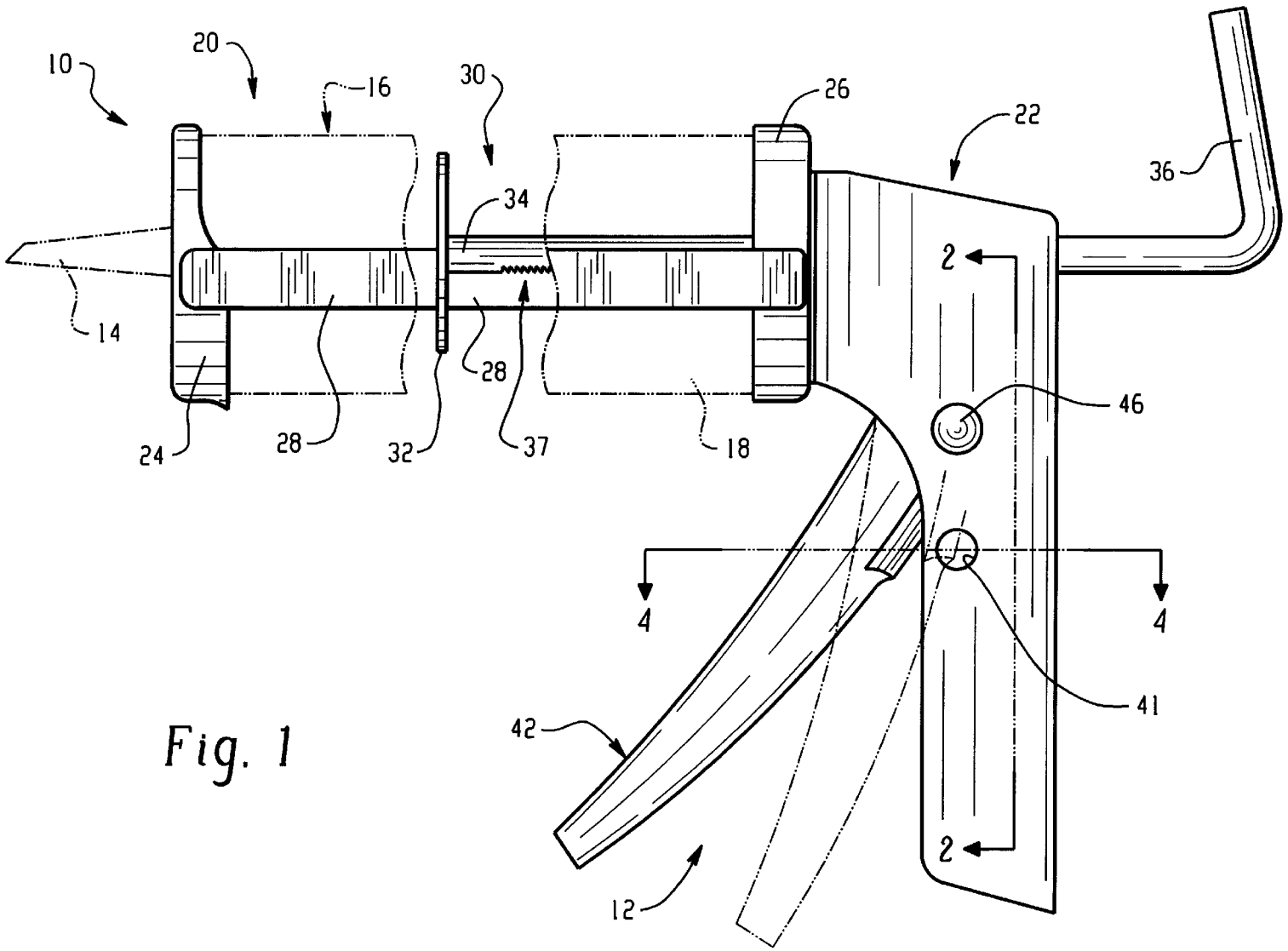
FIG. 1 is a side elevational view caulking gun having a trimmer according to the present invention with the caulking gun and a caulking tube partially in section to show a plunger.

Referring now in detail to the drawings, and in particular to FIG. 1, an exemplary embodiment of a caulking gun 10 according to the present invention is shown. As is explained in detail below, the caulking gun includes an integral trimmer or trimming means 12 for trimming a snout 14 of a tube 16 of caulking material.

The caulking gun 10 is used to dispense a caulking material or a caulking compound from a conventional disposable container, tube or cartridge 16 which generally has a cylindrical body 18 with a hollow conical snout 14 at one end. The tube is closed at an opposite end by an internally mounted cap (not shown) which is slidably movable inside the body of the tube. The snout or nozzle is generally formed of a plastic material and is molded with a closed tip to provide an air seal which prolongs the shelf life of the caulking material.

The caulking gun 10 includes a caulking tube receptacle 20 and a handle 22 attached to one end of the receptacle. The receptacle is sized to receive a standard tube 16 of caulking material and includes a forward end cap 24 having a generally U-shape snout access slot (not shown) that is open at the top to receive the snout 14 of the caulking tube. The caulking receptacle also has a rear end cap 26 spaced apart from and connected to the forward end cap by a pair of connecting arms 28. Other forms of caulking tube receptacle, such as an approximate hemicylinder, also may be used in accordance with the present invention.

The caulking receptacle 20 shown in FIG. 1 also includes a plunger 30 having a piston head 32 attached to one end of a shaft 34 which extends through the rear end cap 26 and the handle 22. The shaft is bent at a distal end thereof to form a plunger handle 36. In the illustrated embodiment, the plunger shaft has ratchet teeth 37, which cooperate with a ratchet pawl (not shown) that is part of a plunger drive in the handle which can advance the plunger toward the forward end cap 24. Activating the plunger drive causes the plunger rod or shaft and the piston head to advance into the caulking tube 16, thereby applying a compression force on the caulking material and causing the caulking material to be dispensed from the tip of the snout 14. Various types of plunger drive may be used in the present invention, including those described in U.S. Pat. Nos. 4,081,112 and 4,802,607.

Figure 2:
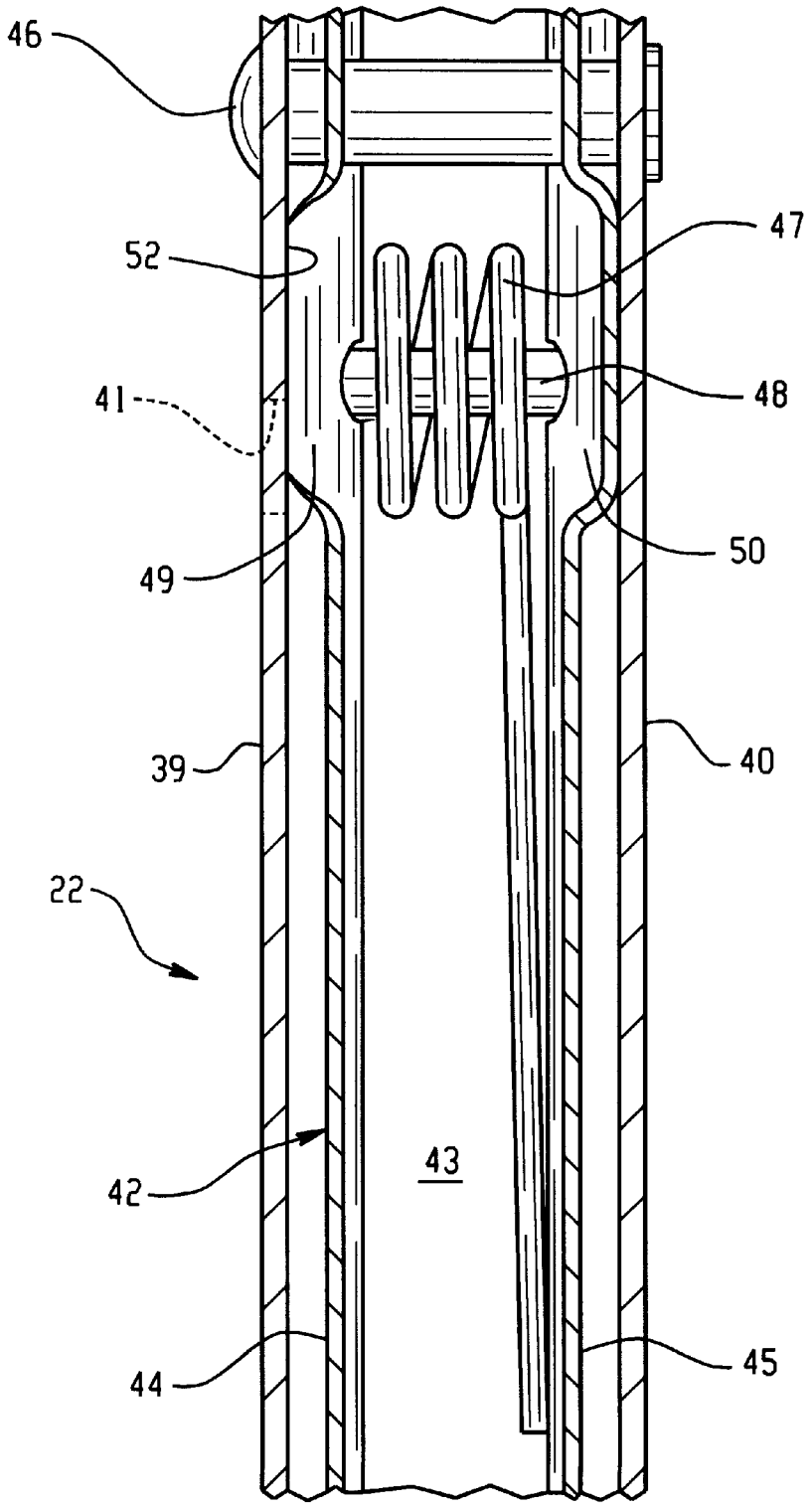
FIG. 2 is a sectional view of a handle of the caulking gun as seen along lines 2—2 in FIG. 1.
Figure 4:
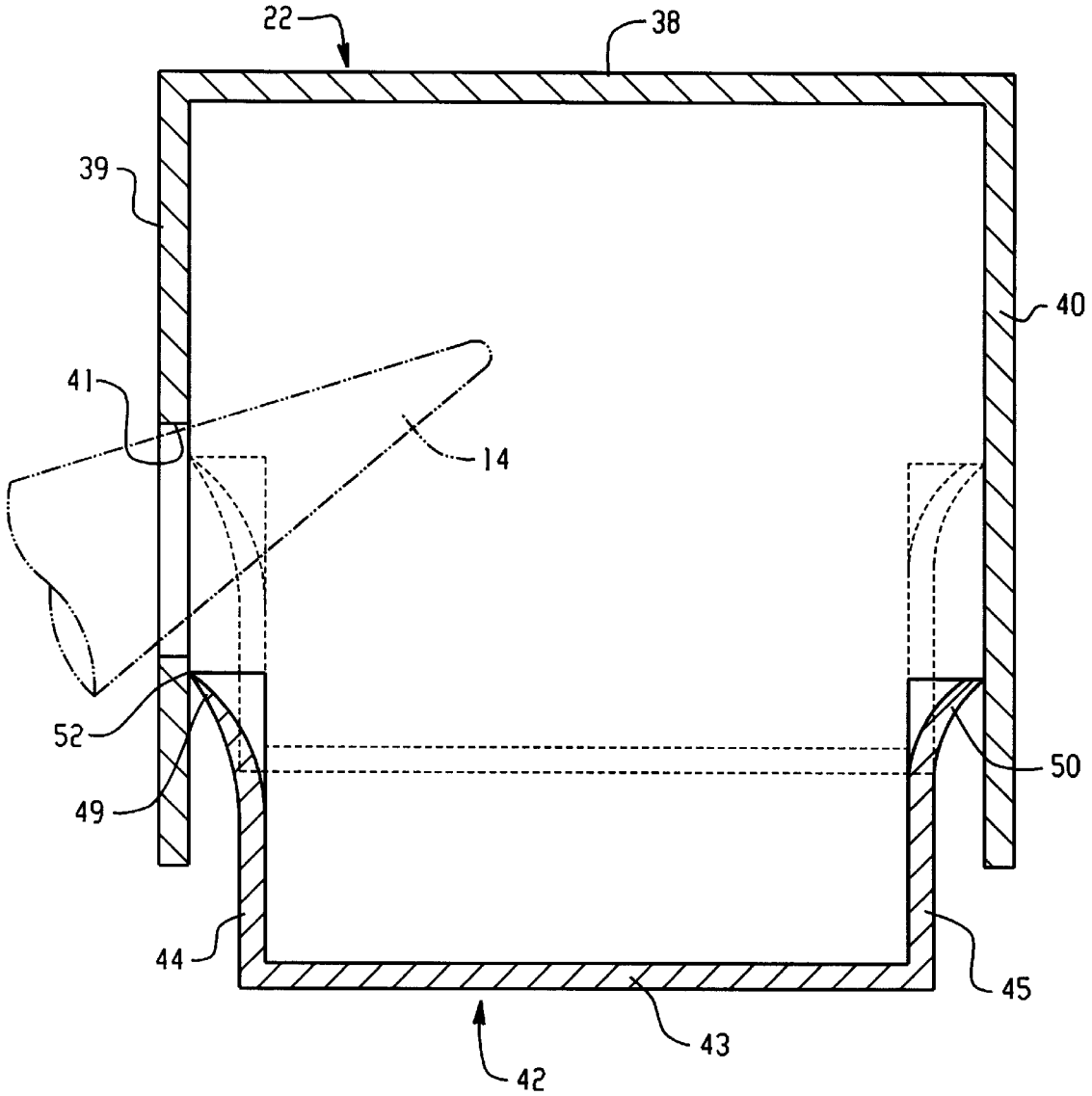
FIG. 4 is a schematic sectional view of the handle as seen along lines 4–4 in FIG. 1.

Referring to FIGS. 1, 2 and 4, the handle 22 of the caulking gun 10 is connected to the rear end cap 26 of the receptacle 20. The handle has a hollow U-shape cross-section formed by a back wall 38 and a pair of side walls 39, 40 connected to opposite sides of the back wall with at least one opening 41 In the side wall 39. A hollow U-shape cross-section trigger 42 with a front wall 43 and a pair of side walls 44, 45 connected to opposite sides of the front wall is pivotally connected to and telescopes within the handle as the trigger is squeezed against the handle. The U-shape cross-sections of the handle and the trigger provide each member with a hollow interior portion between the respective back and side walls (see FIG. 4). The width of the interior portion of the handle is greater than the width of the interior portion of the trigger. This facilitates pivotally mounting the trigger internally of the side walls 39, 40 of the handle by means of a pivot formed by a rivet 46, for example to permit relative movement between the trigger and the handle. Other connecting means may be used to connect the trigger to the handle, however, and the trigger need not be pivotally connected to the handle.

Preferably, the trigger 42 is resiliently biased in an extended forward position, as shown in FIG. 1, by means of at least one spring 47 between the trigger and the handle 22. Preferably, the spring is a torsion spring mounted in the trigger on a spring pin 48. Alternatively, the spring may be mounted on a pin in the handle or the spring may be mounted on the pivot which is formed by the rivet 46. Other types of springs, such as a compression spring, also may be used in accordance with the present invention to bias the trigger to a forward position.

As shown in FIGS. 2 and 4, the trigger 42 has at least one and preferably a pair of opposing flared out portions or flanges 49 and 50 in the opposite side walls 44 and 45. The flanges are flared out and/or extend outward away from each other. The flanges may be formed by a stamping or a forming process in a die or may be made in some other way. The flanges are an integral part of the trigger and ordinarily there would not be a need to weld or otherwise to attach another part to the trigger or the trigger side walls to provide the functions of the flanges. At least one flange has a sharpened edge 52, which passes across the opening 41 in the handle 22 as the trigger is squeezed toward and is telescoped into the handle. The sharpened edge may be formed by stamping or otherwise striking one or both of the sides of the trigger so that at least one flange has a thin distal edge. As a result, one flange may be longer than the other. The thin distal edge may be further sharpened, for example by grinding, to form the sharpened edge 52. The opposing flange 50 engages the opposite side wall of the handle.

The outwardly flared nature of the flanges 49 and 50, combined with the natural elasticity resilience or springiness of the handle material, cooperate to maintain contact between the flanges and the side walls of the handle. The trigger flanges 49, 50 and the side walls of the handle cooperate to provide a secure sliding movement between the handle and the trigger as the trigger and handle are moved relative to each other. Thus, the sharpened edge maintains contact with the handle adjacent the opening 41 and moves relative to the opening in a plane which is parallel to the side wall 39 of the handle adjacent the opening. Sloppiness, slop or side-to-side movement between the handle side walls and the trigger is minimized, thereby helping to assure smoothness, accuracy and ease of the action of cutting the caulking tube snout. As a result, the sharpened edge provides a consistently smooth and clean cut to open the snout 14 at a desired location and angle. Although not shown, a plurality of openings may be provided in one or both side walls 39, 40 of the handle.

FIGS. 1 and 4 illustrate movement of the trigger 42 relative to the handle 22 from a biased extended position to a telescoped cut position shown by the dashed outline of the trigger, for example. These figures clearly illustrate the movement of the flange 44 and the sharpened edge 52 across the opening 41 in the side wall 39 of the handle, with the flange 44 in constant contact with an inside surface of the side wall 39 to ensure a clean cut with minimal vibration. The movement of the trigger moves the sharpened edge from one side of the opening past a distal side of the opening (past the telescoped position shown in dotted outline FIGS. 1 and 4 for purposes of illustration) to ensure that the snout of the caulking tube is completely severed.

Figure 3:
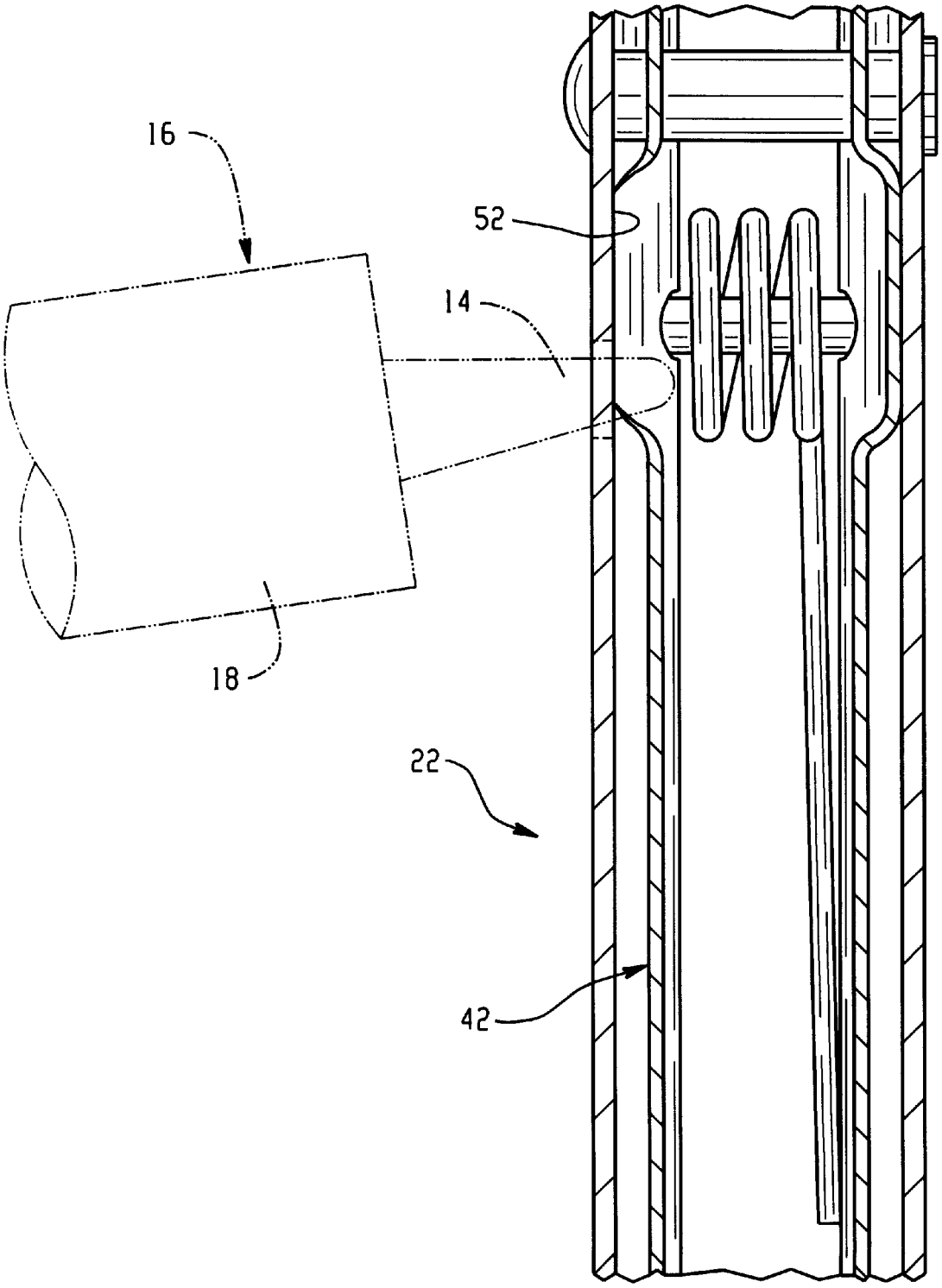
FIG. 3 is a sectional view as seen in FIG. 2 with a snout of a caulking tube inserted in an opening in the handle for trimming by the trimmer.

To use the snout cutter or trimming means 12, the closed snout 14 of a tube 16 of caulking material is inserted through the opening 41 (FIG. 1) in the handle 22 as shown in FIG. 3. The trigger 42 is squeezed to move the sharpened edge 52 across the opening to sever or cut a tip of the snout 14 and to form an opening therein. Preferably, the snout is cut at an angle and the snout may be cut at a different position along a length of the snout depending on the size of the opening in the snout and the bead of caulking material that is desired.

Referring to FIGS. 1 and 3, the caulking gun 10 is loaded and used in the following manner. The plunger 30 is retracted to withdraw the piston head 32 toward the rear end cap 26. The body 18 of the caulking tube 16 is then inserted into the caulking receptacle 20 with the internal cap (not shown) of the caulking tube adjacent or engaging the piston head. The snout is dropped through the U-shape access slot (not shown) in the forward end cap 24. Squeezing the trigger activates the plunger drive (not shown) to advance the piston head which engages the internal cap and applies a compression force to the caulking material in the tube. The trigger may be repeatedly squeezed to incrementally advance the piston head and to urge caulking material from the opening in the snout.

Although the invention has been shown and described with respect to a certain preferred embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a otherwise indicated, to any integer which performs the specified function of the described integer (i.e., that is functionally equivalent), even though not structurally equivalent to the disclosed structure which performs the function in the illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A caulking gun comprising:

a holder to hold a container of caulking material;

a handle connected to the holder, the handle having a pair of side walls and at least one opening in one side wall; and a trigger connected to the handle, the trigger having a pair of side walls and at least one flange which flares out from the side walls and contacts the side wall of the handle having the opening;

wherein the trigger is connected to the handle so that when the trigger is squeezed against the handle, the at least one flange moves across the opening.

2. The caulking gun of claim 1, wherein the trigger has a pair of flanges which contact opposing side walls of the handle.

3. The caulking gun of claim 1, wherein the flange which is movable across the opening has a sharpened edge.

4. The caulking gun of claim 1, wherein the holder includes a plunger and movement of the trigger actuates a plunger drive in the handle to advance the plunger.

5. The caulking gun of claim 1, wherein the trigger is spring biased to a position away from the handle.

6. The caulking gun of claim 1, wherein the trigger has a hollow U-shape cross-section that is open on a side facing the handle.

7. The caulking gun of claim 6, wherein the trigger is telescopically connected to the handle.

8. The caulking gun of claim 1, wherein the at least one flange is an integral part of the trigger.

9. The caulking gun of claim 1, wherein the handle has a hollow U-shape cross-section that is open on a side facing the trigger.

10. The caulking gun of claim 9, wherein the trigger has a hollow U-shape cross-section that is open on a side facing the handle, and the trigger is telescopically connected to the handle.

11. The caulking gun of claim 10, wherein the trigger has a width which is less than a width of the handle such that the trigger can telescope into the handle.

12. The caulking gun of claim 1, wherein the elasticity of at least one of the handle material and the trigger material maintains the contact between the flanges and the side walls of the handle.

13. A method of using a caulking gun to dispense a caulking material from a caulking container having a substantially hollow snout at one end, comprising the steps of:

inserting the snout through an opening in a handle of the caulking gun; and squeezing a trigger which is connected for movement relative to the handle toward the handle, the trigger having a pair of side walls and a pair of flanges which flare out to engage opposing side walls of the handle, with at least one flange having a sharpened edge which moves across the opening to sever a tip of the snout.

14. The method of claim 13, further comprising the steps of placing the caulking container into a holder of the caulking gun having a plunger; and squeezing the trigger toward the handle to incrementally advance the plunger to dispense caulking material from the snout.

15. The method of claim 13, wherein the squeezing step includes telescoping the trigger into the handle.

16. The method of claim 13, wherein in the squeezing step the squeezing toward the handle is opposed by a spring which biases the trigger to an extended position away from the handle.

17. The method of claim 13, further comprising the step of supporting the caulking tube with the plunger and a front end cap having a slot to receive the snout.

18. A caulking gun for applying a caulking material from a container having a snout, comprising:

a handle having a pair of side walls, at least one side wall having at least one opening therein; and a trigger movably connected to the handle, the trigger having a cutting edge and biasing means for urging the cutting edge to engage the side wall having the at least one opening therein as the trigger is forced between the side walls of the handle.

19. The caulking gun of claim 18, wherein the biasing means and the cutting edge are integral parts of the trigger.

20. The caulking gun of claim 18, wherein the trigger has a pair of side walls and the biasing means includes at least one flange which extends outwardly from a side wall of the trigger to engage a side wall of the handle.

21. The caulking gun of claim 20, wherein the biasing means includes a pair of flanges which engage opposing side walls of the handle.

22. The caulking gun of claim 20, wherein the cutting edge forms part of the at least one flange.

* * * * *